US008707501B2

(12) United States Patent
O'Rourke et al.

(10) Patent No.: US 8,707,501 B2
(45) Date of Patent: Apr. 29, 2014

(54) TOOL FOR POINTING BULLNOSE AND METHOD THEREOF

(76) Inventors: Noel F. O'Rourke, Smithtown, NY (US); Juliann Murphy-O'Rourke, Smithtown, NY (US)

( * ) Notice: Subject to any disclaimer, the term of this patent is extended or adjusted under 35 U.S.C. 154(b) by 21 days.

(21) Appl. No.: 13/399,261

(22) Filed: Feb. 17, 2012

(65) Prior Publication Data

US 2013/0212976 A1 Aug. 22, 2013

(51) Int. Cl.
*B05C 17/10* (2006.01)
*E04F 21/165* (2006.01)
*E04G 21/20* (2006.01)

(52) U.S. Cl.
USPC ..... 15/105.5; 15/235.3; 15/235.4; 15/235.7; 425/87; 425/458

(58) Field of Classification Search
USPC ..... 15/105.5, 235.3, 235.4, 235.5, 235.7, 15/235.8, 236.07; 425/87, 458
See application file for complete search history.

(56) References Cited

U.S. PATENT DOCUMENTS 564,831 A * 7/1896 Mylacraine ..... 15/236.07
1,691,777 A * 11/1928 Mayes ..... 15/235.4
3,776,501 A 12/1973 Loftin
3,850,404 A 11/1974 Stegmeier
3,968,191 A 7/1976 Stegmeier
4,631,019 A 12/1986 House
4,649,849 A 3/1987 McCormick
4,669,970 A 6/1987 Perry
5,440,776 A * 8/1995 Kartler ..... 15/235.7
D411,672 S 6/1999 McCoy et al.
5,993,306 A 11/1999 McCoy et al.
6,257,856 B1 7/2001 Stegmeier et al.
D453,672 S 2/2002 McCoy
6,415,472 B1 7/2002 Williams
6,439,983 B1 8/2002 McCoy et al.
6,776,595 B2 * 8/2004 Dewberry ..... 425/78

* cited by examiner

*Primary Examiner* — Randall Chin
(74) *Attorney, Agent, or Firm* — Gerald E. Hespos; Michael J. Porco; Matthew T. Hespos

(57) ABSTRACT

A tool for pointing or filling joints formed between bullnose paving stones or pavers and method thereof are provided. The tool includes an arcuate, resilient body having an inner, concave-shaped surface and an outer, convex-shaped surface, the arcuate, resilient body configured to conform to a convex-shaped rounded portion of each of the at least two adjacent bullnose coping pavers; and a handle coupled to the outer, convex-shaped surface for manipulating the body. The opening of the arcuate, resilient body has an angle of about 45 degrees to about 90 degrees. The resilient body deforms to conform to a variety of sizes of bullnose paving stones or pavers when positioned thereon and returns to its original shape when removed. The tool may further include a finishing member for smoothing a material disposed in the joint formed between the bullnose paving stones or pavers.

14 Claims, 5 Drawing Sheets

TOOL FOR POINTING BULLNOSE AND METHOD THEREOF

BACKGROUND

1. Field

The present disclosure relates generally to masonry tools and, more particularly, to a tool for pointing or filling joints formed between bullnose paving stones or pavers.

2. Description of the Related Art

A swimming pool coping is a structure which functions to cap the upper edge of the side walls of a swimming pool and to provide a transitional element between the side walls and the horizontal deck surrounding the pool. Usually, the coping extends around the periphery of the pool and includes a convex-shaped rounded portion which faces toward the interior of the pool and serves as a hand hold for swimmers to rest or to climb into or out of the pool. Swimming pool copings are constructed of various materials including preformed cement, brick or stone pavers.

Referring to FIGS. 1 and 2, a swimming pool coping 10 is illustrated. The coping 10 includes a plurality of bullnose paving stones or pavers 12. The pavers 12 are located on a wall 14 of a pool so that a convex-shaped rounded portion 16 of each paver 12 extends beyond that edge of the pool wall toward the interior of the pool.

During construction of the pool or installation of the pavers, the plurality of pavers 12 are set in place upon a base 18 of various materials, which may include sand, gravel, concrete, etc. Generally, each paver 12 is set by applying a layer of mortar 20 upon the base 18, laying the pavers upon the layer of mortar 20 and leveling each paver relative to each other. When laying the pavers 12, a joint or space 22 is provided between each paver 12. Each joint 22 is then filled with mortar or grout, also known as pointing.

It is generally difficult to fill the joint 22 near the convex-shaped rounded portion 16 of bullnose pavers. Since the portion 16 extends over the edge of the pool wall, there is no supporting structure to hold the mortar or grout in place until it begins to harden. Furthermore, a mason would prefer to have the mortar or grout have the same shape as the convex-shaped rounded portion 16. One prior method to accomplish this was to overfill the joint 22 between the portion 16 of two adjacent pavers with mortar or grout and then shape the same with a finger of the mason or installer. However, this often results in uneven joints throughout the installation that are physically unappealing and in a large amount of debris, e.g., mortar or grout 24, falling into the pool.

Therefore, a need exists for devices and techniques for pointing or filling joints formed between bullnose paving stones or pavers.

SUMMARY

A tool for pointing or filling joints formed between bullnose paving stones or pavers and method thereof are provided.

According to one aspect of the present disclosure, a tool for filling joints between at least two adjacent bullnose coping pavers is provided, the tool including an arcuate, resilient body having an inner, concave-shaped surface and an outer, convex-shaped surface, the arcuate, resilient body configured to conform to a convex-shaped rounded portion of each of the at least two adjacent bullnose coping pavers; and a handle coupled to the outer, convex-shaped surface for manipulating the body.

In another aspect, an opening of the arcuate, resilient body has an angle of about 45 degrees to about 90 degrees.

In a further aspect, the arcuate, resilient body includes a shape-memory material. In one embodiment, the arcuate, resilient body includes a shape-memory alloy with a rubber coating disposed over the arcuate, resilient body.

In yet a further aspect, the tool includes at least one friction portion on the inner surface of the arcuate, resilient body to facilitate the body gripping the at least two adjacent bullnose coping pavers.

In still another aspect, the handle is replaceably coupled to the arcuate, resilient body.

In another aspect, the tool includes a finishing member coupled to and extending away from the handle configured to smooth the joint formed between the at least two adjacent bullnose coping pavers.

According to another aspect of the present disclosure, a method for filling joints between at least two adjacent bullnose coping pavers is provided, the method including providing a tool including an arcuate, resilient body having an inner, concave-shaped surface and an outer, convex-shaped surface and a handle coupled to the outer, convex-shaped surface for manipulating the body; positioning the body of the tool over a joint formed between at least two adjacent bullnose coping pavers, wherein the arcuate, resilient body is configured to conform to a convex-shaped rounded portion of each of the at least two adjacent bullnose coping pavers; filling the joint with a suitable material until the suitable material conforms to the convex-shaped rounded portion of each of the at least two adjacent bullnose coping pavers; and removing the body of the tool from the at least two adjacent bullnose coping pavers.

BRIEF DESCRIPTION OF THE DRAWINGS

The above and other aspects, features, and advantages of the present disclosure will become more apparent in light of the following detailed description when taken in conjunction with the accompanying drawings in which.

DETAILED DESCRIPTION

Figure 1:
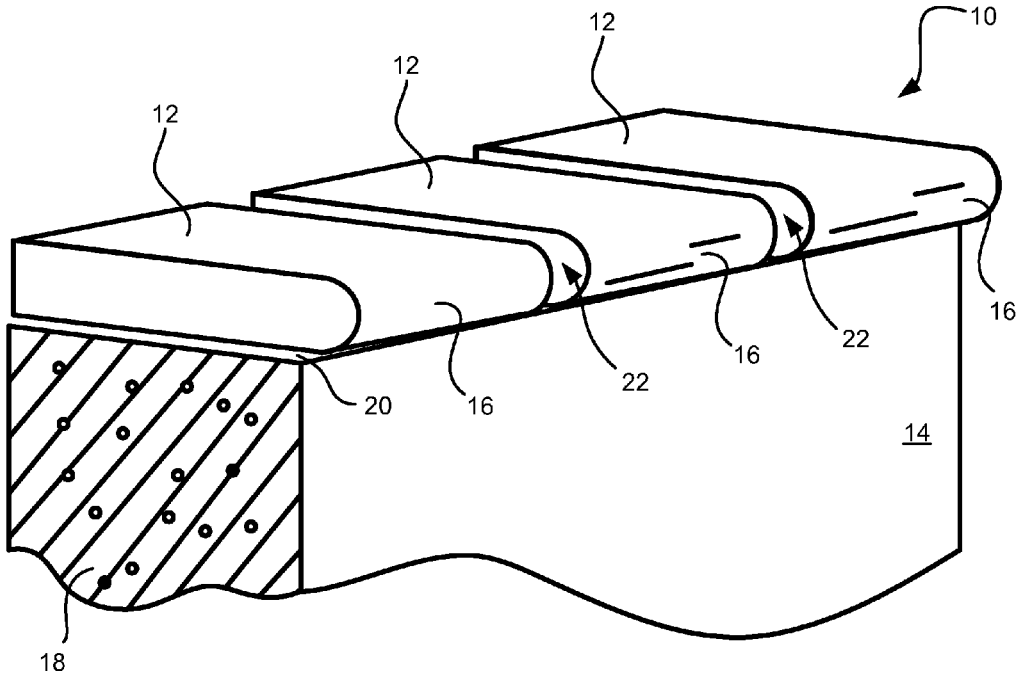
FIG. 1 is a perspective view of a pool coping installation.
Figure 2:
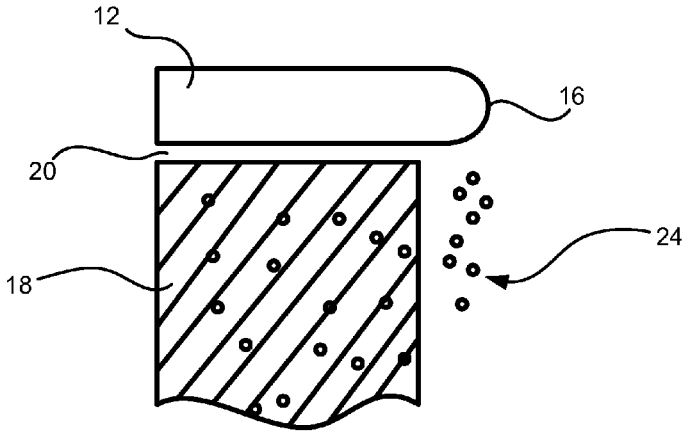
FIG. 2 is a side view of the pool coping installation shown in FIG. 1.
Figure 3:
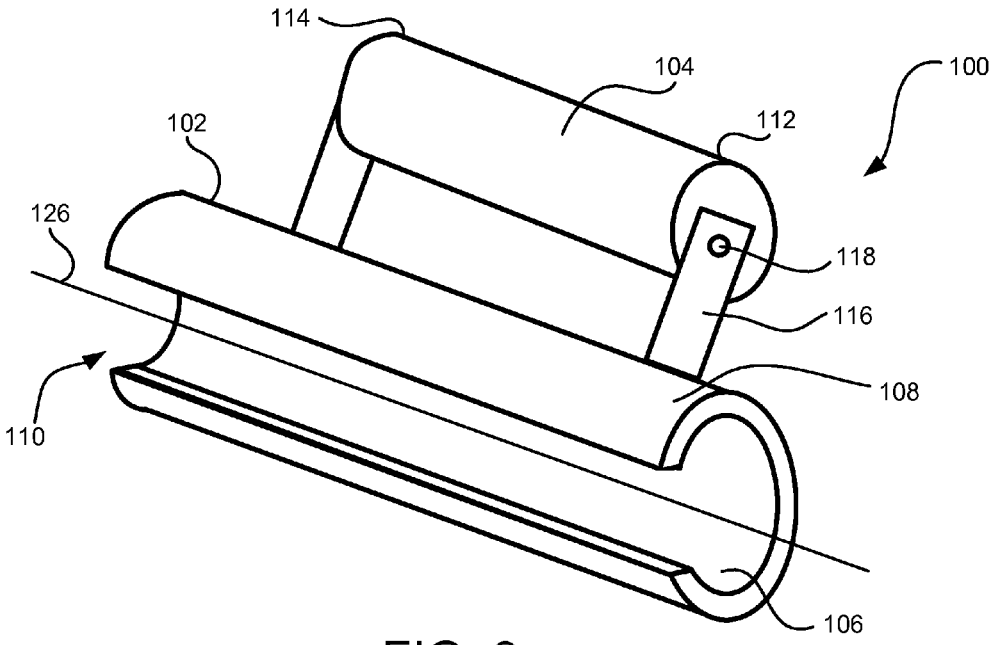
FIG. 3 is a perspective view of a tool for filling joints between at least two adjacent bullnose paving stones or pavers in accordance with an embodiment of the present disclosure.
Figure 4:
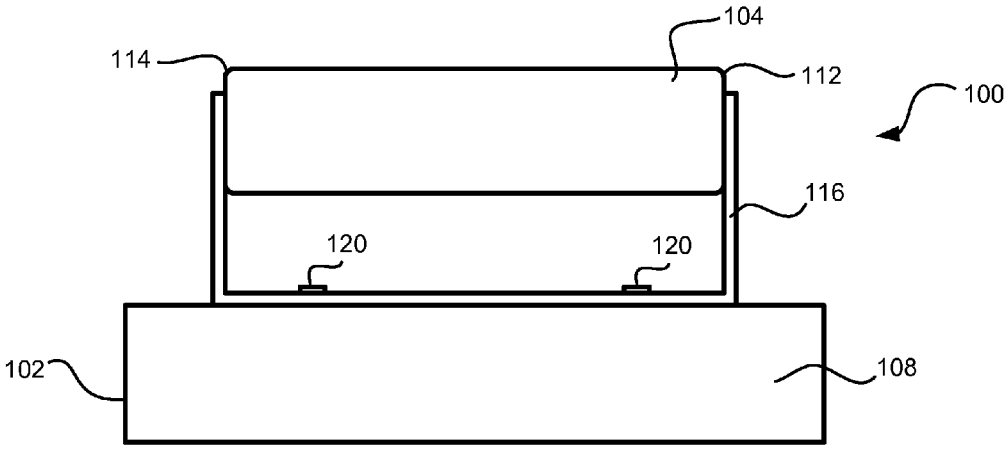
FIG. 4 is a front view of the tool shown in FIG. 3.

The present description illustrates the principles of the present disclosure. It will thus be appreciated that those skilled in the art will be able to devise various arrangements that, although not explicitly described or shown herein, embody the principles of the disclosure and are included within its spirit and scope.

All examples and conditional language recited herein are intended for pedagogical purposes to aid the reader in understanding the principles of the disclosure and the concepts contributed by the inventor to furthering the art, and are to be construed as being without limitation to such specifically recited examples and conditions.

Moreover, all statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

The word "exemplary" is used herein to mean "serving as an example, instance, or illustration." Any configuration or design described herein as "exemplary" is not necessarily to be construed as preferred or advantageous over other configurations or designs.

Referring to FIGS. 3-6, tool 100 for pointing or filling joints formed between bullnose paving stones or pavers is illustrated. The tool 100 includes a generally cylindrical body 102 and a handle 104 coupled to the body 102 for manipulating the tool 102. The body 102 includes an inner, concave-shaped surface 106 and an outer, convex-shaped surface 108. The arcuate body 102 is made from a resilient material and is configured with a slot or opening 110 so the body 102 can be placed over an edge of bullnose coping pavers and conform to a convex-shaped rounded portion of each of the at least two adjacent bullnose coping pavers.

The generally cylindrical handle 104 has its ends 112 and 114 supported by a bracket 116 that is attached to the outer convex-shaped surface 108 of body 102. The handle 104 is coupled to the bracket 116 by any conventional means, e.g., screws 118. It is to be appreciated that the handle and bracket can be made from a variety of materials. For example, the handle may be constructed of wood, rubber, plastic, metal, etc. Likewise, the bracket may be constructed of similar materials. In one embodiment, the handle 104 and bracket 116 can be constructed from the same material, for example, can be molded from a high-strength plastic or resin.

The bracket 116 is coupled to the body 102 by a fastener 120 or any conventional means, e.g., rivets. It is to be appreciated that the fastener 120 may depend on the material used for the body 102.

In a further embodiment, the handle 104 and bracket 116 is a unitary structure, e.g., molded from a high-strength plastic or resin, and is replaceably coupled to the body 102. In this embodiment, the body 102 may be replaceable if worn or has become unusable, for example, grout or cement has dried to the inner surface 106 distorting the concave shape. Here, the bracket may include a connection means for releasably engaging the body 102, e.g., a clip, bolt, tongue and groove connection, etc.

Figure 5:
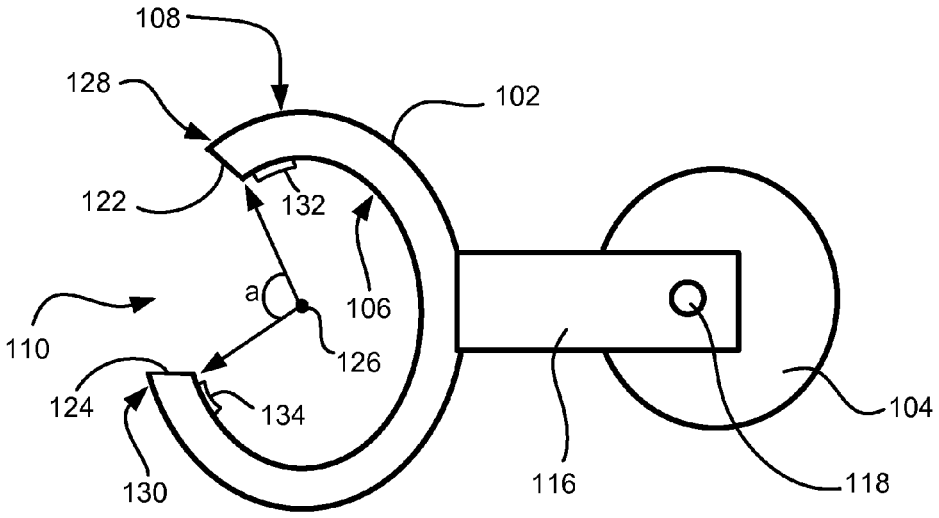
FIG. 5 is a side view of the tool shown in FIG. 3.
Figure 6:
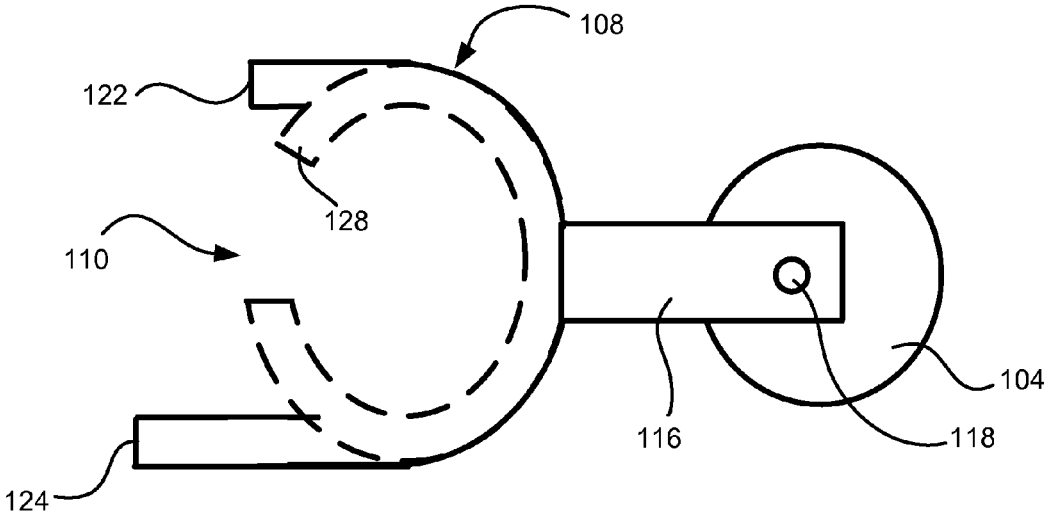
FIG. 6 is another side view of the tool shown in FIG. 3 illustrating a resilient feature of the tool in accordance with an embodiment of the present disclosure.

In one embodiment, the generally cylindrical body 102 is constructed from a shape-memory material that will allow the body 102 to deform when placed over the convex-shaped rounded portion of bullnose coping pavers and return to its original shape when removed from the bullnose coping pavers. Referring to FIGS. 5 and 6, a side view of the tool 100 is illustrated with the body 102 in its original state (FIG. 5) and in a deformed state (FIG. 6). The body 102 includes opening 110 which is set off between first surface 122 and second surface 124. The opening is defined by an angle a between the first surface 122 and second surface 124 relative to the longitudinal axis 126 of the body 102. In the original or undeformed state of the body 102, the angle a is about 45 degrees to about 90 degrees; in other words, a length of an arc segment formed on the inner surface 106 ranges from about 270 degrees to about 315 degrees. Other angles and arc segments are contemplated. It is to be appreciated that the angle of the opening 110 is selected to enable the body 102 to be placed over the convex-shaped rounded portion of a bullnose coping paver and to have the body 102 conform to the convex shape of the bullnose coping paver so that the material used for pointing or filling the joint between two adjacent pavers takes a convex shape. FIG. 6 illustrates the body 102 deformed to take the shape of the convex-shaped rounded portion of the bullnose coping paver, with the original shape of the body shown in dashed lines 128.

By employing a shape-memory material, the tool 100 can be used on bullnose coping pavers of various sizes. The body 102 of tool 100 will conform to the first paver and then return to its original shape when removed. If a subsequent paver is of a different size, the body 102 will then conform to the size of the subsequent paver. This will eliminate the need to have various tools of different sizes and one tool 100 can be used for a complete installation.

It is to be appreciated that the body 102 can be constructed from a variety of shape-memory materials. In one embodiment, the body 102 can be constructed of a shape-memory alloy. In another embodiment, the body 102 may be constructed of a shape-memory alloy or metal coated with rubber. In other embodiments, the body 102 may be constructed from rubber or plastic having shape-memory characteristics. Other resilient materials that allow the body 102 to be bent, pulled, twisted, etc. before reforming its shape when released are contemplated to be within the scope of the present disclosure.

Figure 7:
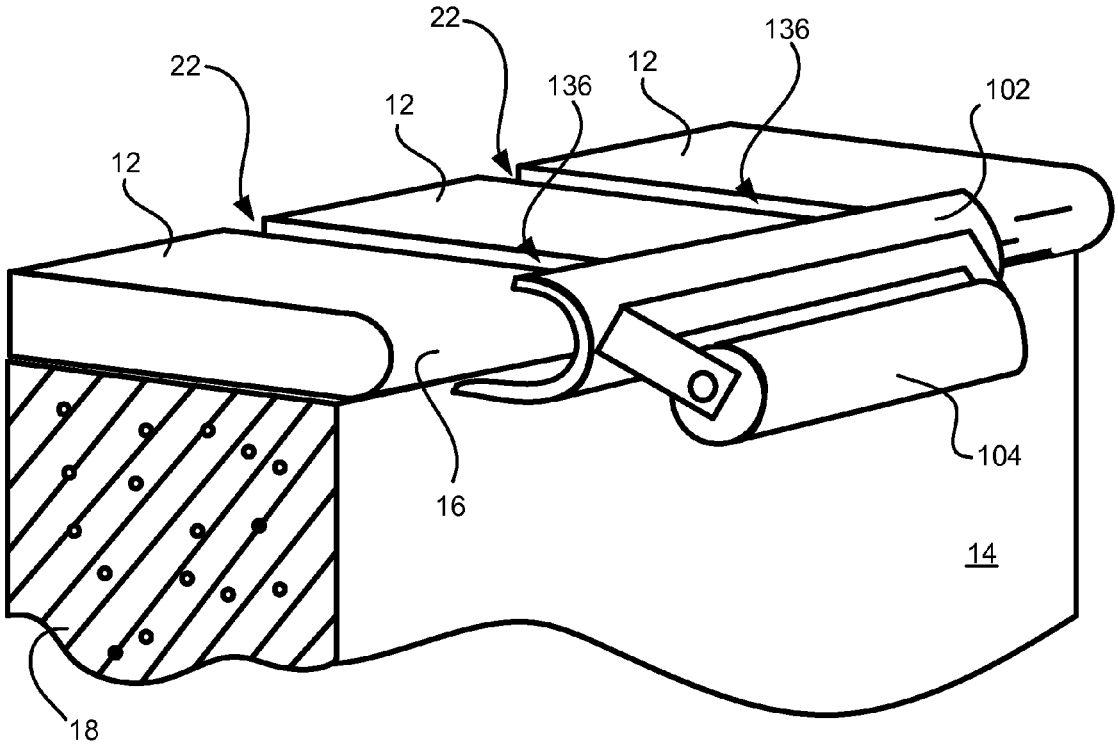
FIGS. 7 and 8 illustrate a method for filling joints between at least two adjacent bullnose paving stones or pavers in accordance with an embodiment of the present disclosure.
Figure 8:
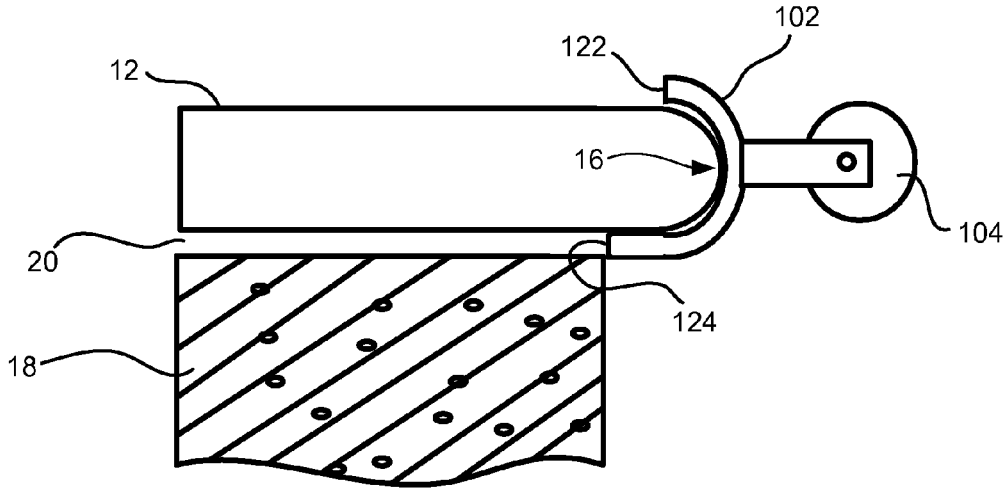

Referring to FIGS. 7 and 8, a method of pointing or filling joints formed between at least two adjacent bullnose paving stones or pavers using the tool 100 of the present disclosure will be described. The tool 100 is manipulated by a user via handle 104 so that body 102 is placed over the convex-shaped rounded portion 16 of at least two adjacent bullnose pavers 12. As can be seen in FIG. 8, second surface 124 contacts the layer of mortar 20 while the first surface 122 of the body 102 deforms to conform the body 102 to the shape of convex-shaped rounded portion 16 of the paver 12. The tool 100 can now be held in place by the user via the handle 104. Alternatively, depending on the thickness and strength of the body 102, the tool 100 may be self-supporting once positioned on the pavers 12. In this embodiment, portions 128, 130 of the body 102 near first and second surfaces 122, 124 will tend to exert a force toward the longitudinal axis 126 of the body 102 to hold on to portion 16 of the paver 12. In another embodiment, the portions 128, 130 of the body 102 will include a friction portion 132, 134 on the inner surface 106 to facilitate the body gripping the paver 12. In one embodiment, the friction portion 132, 134 may be a portion of the inner surface that is roughed or scored. In another embodiment, the friction portion 132, 134 may be a layer of a predetermined material such as rubber or the like. Once the tool 100 is positioned on the pavers, grout or other suitable material can be introduced into the joint 22 at access point 136. The grout will fill the joint between the pavers and make contact with the inner surface 106 of the body 102 causing the grout in the joint to take the shape of the convex-shaped rounded portion 16 of the paver 12. Once the joint is filled with grout, the tool 100 can be removed and positioned at the next joint.

In this manner, the tool 100 of the present disclosure minimizes or eliminates the amount of cement, grout, dust or any other material that falls into a pool while pointing the joints. It is to be appreciated that although the above was described in relation to preparing coping for a pool installation, the tool of the present disclosure can be employed in any installation requiring bullnose pavers, for example, a patio, stairs, etc.

Figure 9:
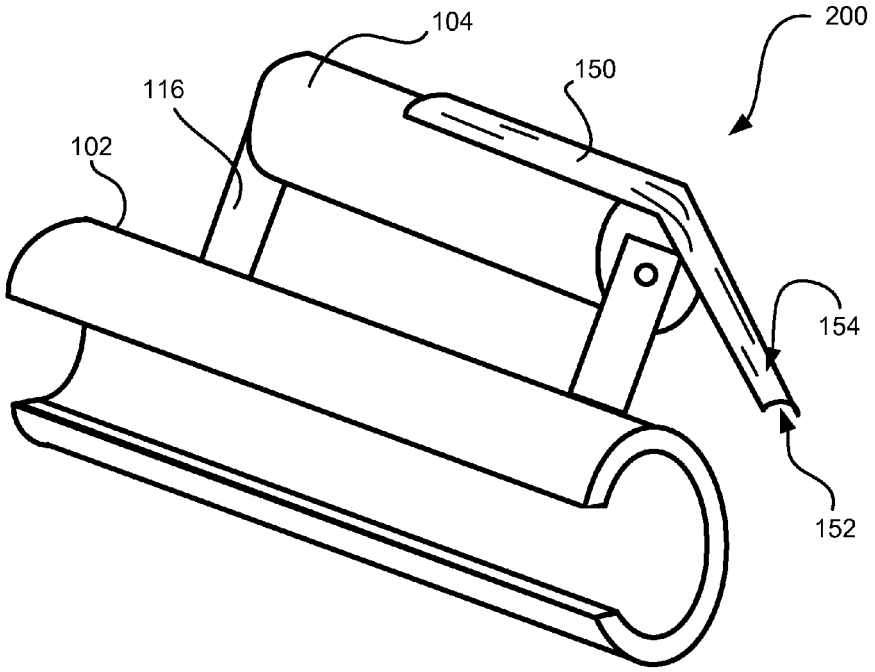
FIG. 9 is a perspective view of a tool for filling joints between at least two adjacent bullnose paving stones or pavers in accordance with another embodiment of the present disclosure.
Figure 10:
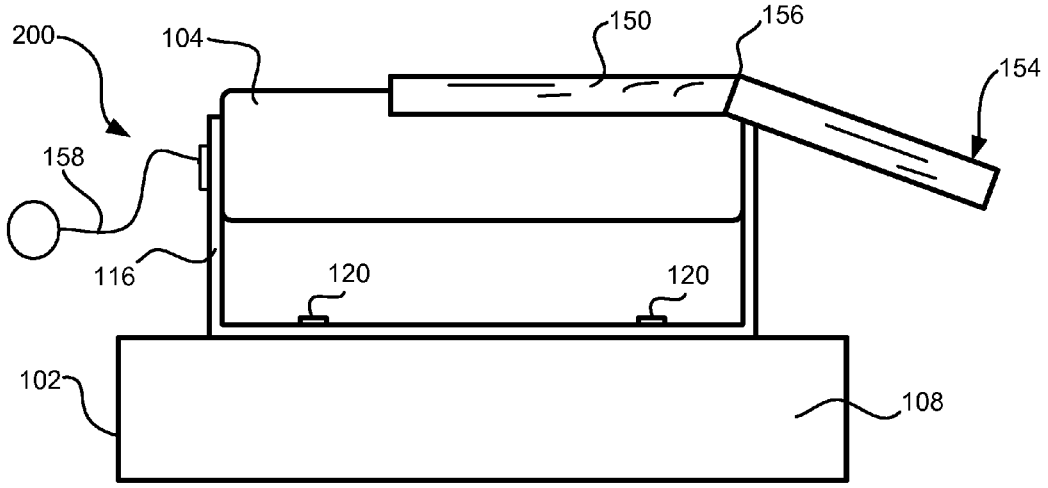
FIG. 10 is a front view of the tool shown in FIG. 9.

Referring to FIGS. 9-10, another embodiment of a tool 200 for pointing or filling joints formed between bullnose paving stones or pavers is illustrated. In this embodiment, a finishing member 150 is coupled to the handle 104 and extends away from the handle 104. The finishing member 150 is provided to smooth the grout or other suitable material that has been placed between the joints and formed by the tool of the present disclosure as described above. The finishing member 150 is made from a rigid material includes a concave-shaped surface 152 and a convex-shaped surface 154. The underlying, concave-shaped surface 152 mates with the cylindrical handle 104 for facilitating the coupling of the finishing member 150 to the handle 104. It is to be appreciated that the finishing member 150 may be constructed from the same materials as the handle 104 and bracket 116 as described above. Furthermore, the finishing member 150, handle 104 and bracket 116 may be formed as a unitary structure.

In use, the joint between two pavers is filled as described above in relation to FIGS. 7-8. Once the joint is filled, the convex-shaped surface 154 of the finishing member 150 is employed to be applied to the grout or other suitable material in the joint to give the material a smooth appearance.

It is to be appreciated that the finishing tool 150 may be angled at point 156 to reduce the overall dimensions of the tool 200 to make it more compact.

In another embodiment, the tool 200 includes a tethering member 158 for tethering the tool 200 to a point external to, for example, a pool. The tethering member 158 may be, but is not limited too, a chain, rope, cord, etc. The tethering member 158 may be coupled to the body 102, handle 104 or bracket 116. The tethering member 158 will tether the tool 200 to the user or other structure, e.g., a bucket, to prevent the tool 200 from accidentally falling into a pool during an installation.

Although the disclosure herein has been described with reference to particular illustrative embodiments, it is to be understood that these embodiments are merely illustrative of the principles and applications of the present disclosure. Therefore numerous modifications may be made to the illustrative embodiments and other arrangements may be devised without departing from the spirit and scope of the present disclosure, which is defined by the appended claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

What is claimed is:

1. A tool for filling joints between at least two adjacent bullnose coping pavers, the tool comprising:

an arcuate, resilient body having an inner, concave-shaped surface and an outer, convex-shaped surface, the arcuate, resilient body including an opening along a longitudinal axis defining a first portion and a second portion of the body, the arcuate, resilient body configured to conform to a convex-shaped rounded portion of each of the at least two adjacent bullnose coping pavers; and a handle coupled to the outer, convex-shaped surface for manipulating the body, wherein the handle is positioned on the outer, convex-shaped surface of the body so that the second portion of the body is longer than the first portion of the body relative to the position of the handle.

2. The tool of claim 1, wherein the opening of the arcuate, resilient body has an angle of about 45 degrees to about 90 degrees.

3. The tool of claim 1, wherein the arcuate, resilient body comprises a shape-memory material.

4. The tool of claim 1, wherein the arcuate, resilient body comprises a shape-memory alloy.

5. The tool of claim 4, further comprising a rubber coating disposed over the arcuate, resilient body.

6. The tool of claim 1, further comprising at least one friction portion on the inner surface of the arcuate, resilient body to facilitate the body gripping the at least two adjacent bullnose coping pavers.

7. The tool of claim 6, wherein the at least one friction portion is scored.

8. The tool of claim 6, wherein the at least one friction portion comprises rubber material.

9. The tool of claim 1, wherein the handle is replaceably coupled to the arcuate, resilient body.

10. The tool of claim 1, further comprising a finishing member coupled to and extending away from the handle configured to smooth the joint formed between the at least two adjacent bullnose coping pavers.

11. A tool for filling joints between at least two adjacent bullnose coping pavers, the tool comprising:

an arcuate, resilient body having an inner, concave-shaped surface and an outer, convex-shaped surface, the arcuate, resilient body configured to conform to a convex-shaped rounded portion of each of the at least two adjacent bullnose coping pavers, wherein a length of an arc segment formed on the inner surface ranges from about 270 degrees to about 315 degrees;

a handle coupled to the outer, convex-shaped surface by a bracket, the handle configured for manipulating the body; and a finishing member coupled to and extending away from the handle configured to smooth the joint formed between the at least two adjacent bullnose coping pavers.

12. The tool of claim 11, wherein the handle and bracket is a unitary structure.

13. The tool of claim 12, wherein the unitary structure is replaceably coupled to the arcuate, resilient body.

14. A tool for filling joints between at least two adjacent bullnose coping pavers, the tool comprising:

an arcuate, resilient body having an inner, concave-shaped surface and an outer, convex-shaped surface, the arcuate, resilient body including an opening along a longitudal axis defining a first portion and a second portion of the body, wherein each of the first and second portions are individually deformable;

a handle coupled to the outer, convex-shaped surface by a bracket, the handle configured for manipulating the body, wherein the handle is positioned on the outer, convex-shaped surface of the body so that the second portion of the body is longer than the first portion of the body relative to the position of the handle; and a finishing member coupled to and extending away from the handle configured to smooth the joint formed between the at least two adjacent bullnose coping pavers.

* * * * *